US008118641B2

(12) United States Patent
Kulp et al.

(10) Patent No.: US 8,118,641 B2
(45) Date of Patent: Feb. 21, 2012

(54) CHEMICAL MECHANICAL POLISHING PAD HAVING WINDOW WITH INTEGRAL IDENTIFICATION FEATURE

(75) Inventors: Mary Jo Kulp, Newark, DE (US); Ethan S. Simon, Abington, PA (US); Darrell String, Havre de Grace, MD (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 476 days.

(21) Appl. No.: 12/397,535

(22) Filed: Mar. 4, 2009

(65) Prior Publication Data

US 2010/0227533 A1 Sep. 9, 2010

(51) Int. Cl.
*B24B 49/00* (2012.01)

(52) U.S. Cl. ..... 451/6; 451/41; 451/539

(58) Field of Classification Search ..... 451/6, 41, 451/56, 527, 539
See application file for complete search history.

(56) References Cited

U.S. PATENT DOCUMENTS 4,193,671 A 3/1980 Erickson et al.
4,437,269 A * 3/1984 Shaw ..... 451/526
5,102,169 A 4/1992 Mayfield
5,533,923 A * 7/1996 Shamouilian et al. ..... 451/41
5,584,146 A * 12/1996 Shamouillan et al. ..... 451/41
5,605,760 A 2/1997 Roberts
5,918,341 A * 7/1999 Hale ..... 15/209.1
6,090,475 A * 7/2000 Robinson et al. ..... 428/212
6,106,661 A * 8/2000 Raeder et al. ..... 451/259
6,136,043 A * 10/2000 Robinson et al. ..... 8/485
6,168,508 B1 1/2001 Nagahara et al.
6,257,098 B1 7/2001 Cirone
6,264,533 B1 * 7/2001 Kummeth et al. ..... 451/296
6,599,177 B2 * 7/2003 Nevoret et al. ..... 451/526
6,656,019 B1 * 12/2003 Chen et al. ..... 451/41
6,685,537 B1 2/2004 Fruitman et al.
6,752,690 B1 * 6/2004 Fruitman ..... 451/6
7,018,581 B2 3/2006 David et al.
7,108,596 B2 * 9/2006 Nevoret et al. ..... 451/526
2005/0189065 A1 * 9/2005 Boldizar et al. ..... 156/250
2007/0010169 A1 1/2007 Swisher et al.
2008/0004743 A1 1/2008 Goers et al.

* cited by examiner

*Primary Examiner* — Maurina Rachuba
(74) *Attorney, Agent, or Firm* — Thomas S. Deibert

(57) ABSTRACT

Chemical mechanical polishing pads having a window with an integral identification feature, wherein the window has a polishing face and a nonpolishing face, wherein the integral identification feature is observable through the window, and wherein the integral identification feature identifies the chemical mechanical polishing pad as a type of chemical mechanical polishing pad selected from a plurality of types of chemical mechanical polishing pads. Also provided is a method of making such chemical mechanical polishing pads and for using them to polish a substrate selected from a magnetic substrate, an optical substrate and a semiconductor substrate.

10 Claims, 11 Drawing Sheets

CHEMICAL MECHANICAL POLISHING PAD HAVING WINDOW WITH INTEGRAL IDENTIFICATION FEATURE

The present invention relates generally to the field of chemical mechanical polishing. In particular, the present invention is directed to a chemical mechanical polishing pad having a window with an integral identification feature and methods of making and using the same.

Chemical mechanical planarization, or chemical mechanical polishing (CMP), is a common technique used to polish substrates, such as semiconductor wafers. In conventional CMP using a dual-axis rotary polisher, a wafer carrier, or polishing head, is mounted on a carrier assembly. The polishing head holds the wafer and positions it in contact with a polishing layer of a polishing pad within the polisher. The polishing pad typically exhibits a diameter greater than twice the diameter of the wafer being planarized. During polishing, each of the polishing pad and the wafer is rotated about its respective central axis while the wafer is engaged with the polishing layer. The central axis of the wafer is offset relative to the central axis of the polishing pad by a distance greater than the radius of the wafer such that the rotation of the pad sweeps out a ring-shaped "wafer track", the region on the polishing surface which contacts the wafer during polishing. When the only movement of the wafer is rotational, the width of the wafer track is equal to the diameter of the wafer. However, in some dual-axis polishers, the wafer is oscillated in a plane perpendicular to its axis of rotation. In this case, the width of the wafer track is wider than the diameter of the wafer by an amount that accounts for the displacement due to the oscillation.

An important step in CMP is determining an end-point to the process. Accordingly, a variety of planarization end-point detection methods have been developed, for example, methods involving optical in-situ measurements of the wafer surface. The optical technique involves providing the window polishing pad with a window that is transparent for select wavelengths of light. A light beam is directed through the window to the wafer surface, where it reflects and passes back through the window to a detector (e.g., a spectrophotometer). Based on the return signal, properties of the wafer surface (e.g., the thickness of films) can be determined for end-point detection.

To facilitate an increasing number of different polishing processes being implemented in, for example, the manufacture of integrated circuits and other electronic devices, many different chemical mechanical polishing pads have already been developed and more are under active development. The suite of current chemical mechanical polishing pad options includes polishing layers comprising porous and non-porous polymers, film and felt based poromeric materials and a variety of surface modification options (e.g., groove patterns). The various polishing layer options may be combined with various subpad and intermediate layer options, different stack adhesives, window options, etc. Each of these various options has the potential for altering the polishing properties of the resultant chemical mechanical polishing pad. The selection and installation of the proper chemical mechanical polishing pad is important to achieve the desired polishing results. The inadvertent installation of the wrong chemical mechanical polishing pad can result in significant lost time and may cause costly device damage and yield losses. This concern is exacerbated by the fact that many chemical mechanical polishing pads having substantially different polishing properties can have a similar appearance. Accordingly, it is becoming an increasing concern for semiconductor fabrication facility operators to have an effective means to quickly and easily identify chemical mechanical polishing pads.

One approach to facilitating identification of polishing pads is disclosed in U.S. Pat. Nos. 5,533,923 and 5,584,146 to Shamouillan et al. Shamouillan et al. disclose a structure useful as a polishing pad for chemical mechanical polishing, comprising: (a) plurality of conduits; and (b) a matrix of material in contact with and supporting said conduits and shaped to form a polishing pad; wherein, said conduits are constructed from a first material which is different from a second material used as said support matrix, wherein said conduits are positioned within said support matrix in a manner such that longitudinal centerlines of said conduits form an angle principally ranging from about 60° to about 120° with the working surface of said polishing pad and wherein the polishing pad is color coded to identify the chemical compatibility of the pad, so that the user can easily select from his inventory the pad which is compatible with the polishing operation to be performed.

Notwithstanding, there is a continuing need for improved methods of identifying and distinguishing various chemical mechanical polishing pads to reduce the likelihood that the wrong chemical mechanical polishing pad will be installed on a polisher for a given polishing operation and to increase the likelihood that a misoperation event involving the inadvertent installation of the wrong type of chemical mechanical polishing pad is avoided.

In one aspect of the present invention, there is provided a chemical mechanical polishing pad for polishing a substrate selected from a magnetic substrate, an optical substrate and a semiconductor substrate; comprising: a polishing layer having a polishing surface adapted for polishing the substrate, a window and an integral identification feature; and, wherein the window has a polishing face and a nonpolishing face, wherein the integral identification feature is observable through the window, wherein the integral identification feature identifies the chemical mechanical polishing pad as a type of chemical mechanical polishing pad selected from a plurality of types of chemical mechanical polishing pads.

In another aspect of the present invention, there is provided a method of making the chemical mechanical polishing pad having a window with an integral identification feature, comprising: providing a polishing layer with a polishing surface and a window, wherein the window has a polishing face and a nonpolishing face and wherein the polishing face is parallel with the polishing surface; providing an integral identification feature; and, interfacing the integral identification feature with the polishing layer; wherein the integral identification feature is observable through the window at the polishing face; and, wherein the polishing surface is adapted for polishing the substrate.

In another aspect of the present invention, there is provided a method for chemical mechanical polishing of a substrate selected from a magnetic substrate, an optical substrate and a semiconductor substrate, comprising: providing a chemical mechanical polishing apparatus having a platen; providing at least one substrate selected from a magnetic substrate, an optical substrate and a semiconductor substrate; providing at least two polishing operations; providing a plurality of types of chemical mechanical polishing pads having a window, wherein each type of chemical mechanical polishing pad has different polishing properties and an integral identification feature to distinguish each type of chemical mechanical polishing pad from the other types of chemical mechanical polishing pads in the plurality of types, wherein the integral identification feature is non-polish active, wherein the integral identification feature is selected to be observable through the window and to uniquely identify each type of chemical mechanical polishing pad in the plurality of types; providing at least two polishing recipes, wherein each polishing recipe corresponds to one of the at least two polishing operations and wherein each polishing recipe includes an identification of the integral identification feature associated with the type of chemical mechanical polishing pad to be used; selecting a polishing operation to be performed from the at least two polishing operations ("the selected polishing operation") and a corresponding polishing recipe ("the selected recipe"); installing onto the platen the type of chemical mechanical polishing pad identified in the selected recipe; observing the integral identification feature of the installed chemical mechanical polishing pad and verifying that it corresponds with that identified in the selected recipe; and performing the selected polishing operation on the at least one substrate.

DETAILED DESCRIPTION

Figure 1:
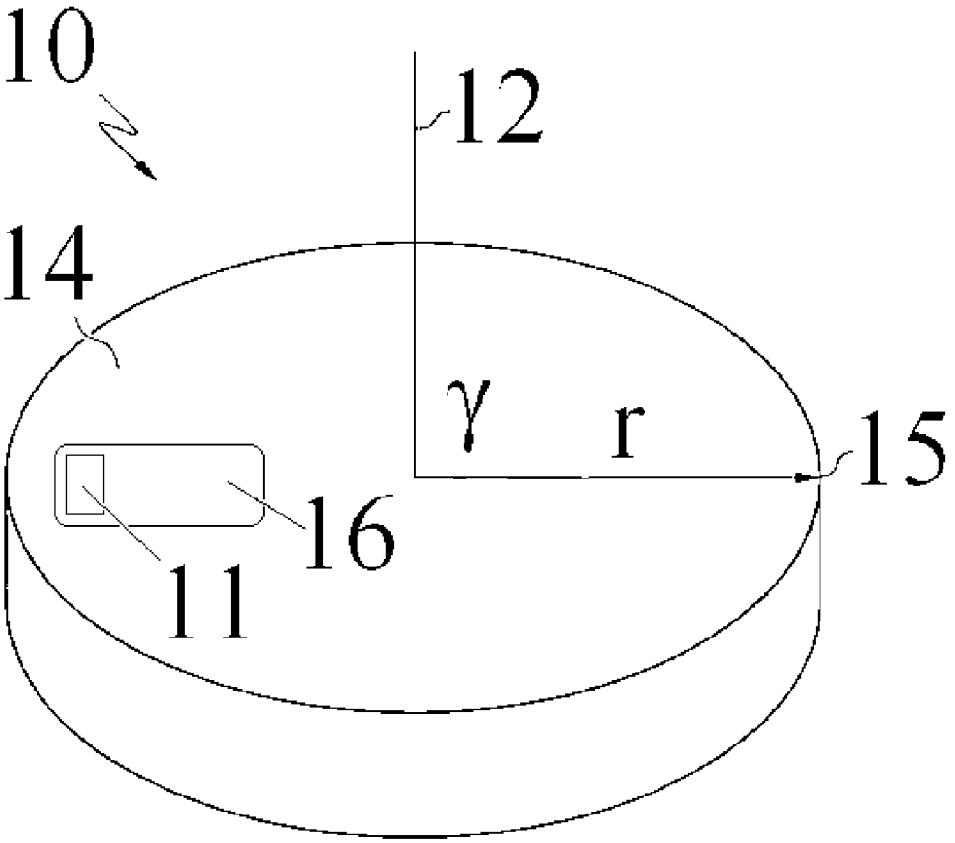
FIG. 1 is a depiction of a perspective top/side view of a chemical mechanical polishing pad of the present invention having a substantially circular cross section.

The term "substantially circular cross section" as used herein and in the appended claims in reference to a chemical mechanical polishing pad or a polishing pad component (e.g., polishing layer 10) means that the longest radius, r, of a cross section from a central axis 12 to an outer periphery 15 of the polishing pad or pad component is ≦20% longer than the shortest radius, r, of the cross section from the central axis 12 to the outer periphery 15. (See FIG. 1).

The term "polishing medium" as used herein and in the appended claims encompasses particle-containing polishing solutions and non-particle-containing solutions, such as abrasive-free and reactive-liquid polishing solutions.

The term "color based indicia" as used herein and in the appended claims means a color that is both detectable by a human observer having normal color vision and distinguishable by a human observer having normal color vision from the color of any other color based indicia in the integral identification feature and the color(s) exhibited by adjacent portions of the chemical mechanical polishing pad.

The term "colorfast" as used herein and in the appended claims in reference to a color indicia means that the color of the indicia will not bleed or fade during polishing.

The term "observable" as used herein and in the appended claims in reference to a given visually distinct indicia of an integral identification feature means that a human observer (including one having a color vision impairment) will be able to see and distinguish the visually distinct indicia from other visually distinct indicia of the integral identification feature and the adjacent portions of the chemical mechanical polishing pad.

The term "poly(urethane)" as used herein and in the appended claims encompasses (a) polyurethanes formed from the reaction of (i) isocyanates and (ii) polyols (including diols); and, (b) poly(urethane) formed from the reaction of (i) isocyanates with (ii) polyols (including diols) and (iii) water, amines or a combination of water and amines.

The chemical mechanical polishing pad of the present invention contains an integral identification feature to facilitate unique identification of the chemical mechanical polishing pad by polishing pad type (e.g., IC1000® available from Rohm and Haas) and to distinguish it from other types of chemical mechanical polishing pads (e.g., VisionPad® 5000 available from Rohm and Haas). It is important to note that, according to some reports, as much as eight percent of the male population and less than one percent of the female population has some form of color vision impairment. Color vision impairments alter the way that colors are perceived by the impaired individual. Depending on the type and severity of the color vision impairment, colors that are easily differentiable to individuals having normal color vision may be indistinguishable for the color vision impaired individual. Optionally, to facilitate the manual installation of chemical mechanical polishing pads onto a chemical mechanical polishing apparatus and to alleviate potential concerns associated with simple color identification by human observers, a combination of color and non-color based visual indicia can be implemented to identify different types of chemical mechanical polishing pads for human observers, including those individuals having a color vision impairment.

The integral identification feature of the present invention is a non-polish active feature. That is, the integral identification feature exhibits no inherent physical or chemical effect on polishing. Preferably, the integral identification feature is observable throughout the useful lifetime of the chemical mechanical polishing pad. Preferably, the integral identification feature is incorporated in a portion of the chemical mechanical polishing pad that falls within the wafer track or polishing track. Preferably, in configurations of the chemical mechanical polishing pads of the present invention wherein the integral identification feature is incorporated in a portion of the polishing layer, the integral identification feature does not extend through the entire thickness of the polishing layer. More preferably, the integral identification feature is not incorporated at the polishing surface of the polishing layer. Most preferably, the integral identification feature is not incorporated in the polishing layer.

The integral identification feature comprises at least one color based indicia. Optionally, the color based indicia is selected to be sufficient by itself to uniquely identify a chemical mechanical polishing pad as a given type of chemical mechanical polishing pad for the purpose of machine sensing. A variety of color sensors are commercially available that are suitable for use with the present invention. Some examples of commercially available color sensors include the PCS-II USB-Connected Perceptive Color Sensor (reported to recognize up to 255 user defined colors with a color resolution of $<1$ $\Delta E$) available from Saelig Pittsford, N.Y. and the X-Rite® Vericolor® Non-contact color sensors (reported to store information on up to 50 active colors with a color resolution of 0.25 ΔE) commercially available from JR Technical Services Inc., Oakville, Ontario, Canada.

Optionally, the integral identification feature comprises at least two visually distinct characteristics observable through the window at the polishing face throughout the useful life of the chemical mechanical polishing pad, wherein at least one of the at least two visually distinct characteristics is a color based indicia, wherein at least one of the at least two visually distinct characteristics is a non-color indicia and wherein the at least two visually distinct characteristics are selected to uniquely identify a chemical mechanical polishing pad by type of chemical mechanical polishing pad to a human observer (including those having color vision impairments).

Non-color indicia comprise a two-dimensional shape or outline observable through the window at the polishing face throughout the useful life of the chemical mechanical polishing pad. Preferred two-dimensional shapes are selected from a polygon, a reuleaux polygon, a circle, an oval, an ellipse, a lens, a lune, a superellipse, a squoval, a squircle, a quartic plane curve, a fractal, a symbol (e.g., letters, characters, numbers) and a combination of at least two of the foregoing shapes. The two-dimensional shapes can be in outline form with the outer periphery of the shape having a color different from that of adjacent portions of the chemical mechanical polishing pad. The two-dimensional shapes can also be in filled form, wherein the entire two-dimensional shape is filled in with a given color different from that of adjacent portions of the chemical mechanical polishing pad. When combinations of two-dimensional shapes are used, they can be adjacent or overlapping. When the combinations are overlapping, the overlapped portion of the shapes can be a different color from the non-overlapped portions.

Non-color indicia suitable for use with the present invention are observable through the window at the polishing face throughout the useful life of the chemical mechanical polishing pad. Preferably, the non-color indicia is a two-dimensional shape or outline selected from a polygon, a reuleaux polygon, a circle, an oval, an ellipse, a lens, a lune, a superellipse, a squoval, a squircle, a quartic plane curve and a symbol. More preferably, the non-color indicia is a two-dimensional shape or outline selected from a reuleaux rectangle, a rectangle, a circle, a reuleaux square, a squircle, a squoval, a square and a symbol. Still more preferably, the non-color indicia is a two-dimensional outline selected from a reuleaux retangle, a rectangle, a reuleaux square, a squircle and a squoval.

The non-color indicia, optionally, comprises at least two non-color indicia observable through the window at the polishing face throughout the useful life of the chemical mechanical polishing pad. The at least two non-color indicia can be the same or different shapes (e.g., two adjacent rectangular shaped indicia). The non-color indicia can be in outline form with the border of the non-color indicia in one color and the center of the indicia in another. The non-color indicia can be in a filled form with the whole non-color indicia in one color. The at least two non-color indicia can overlap one another. Preferably, the non-overlapping portion of at least one of the at least two non-color indicia can be a different color from the overlapped portion. Preferably, the at least two non-color indicia are selected from a combination of two-dimensional shapes observable at the polishing face throughout the useful life of the chemical mechanical polishing pad. The at least two non-color indicia can each be selected from a polygon, a reuleaux polygon, a circle, an oval, an ellipse, a lens, a lune, a superellipse, a squoval, a squircle, a quartic plane curve, a fractal, and a symbol. More preferably, the at least two non-color indicia can each be selected from a reuleaux rectangle, a rectangle, a reuleaux square, a squircle and a squoval.

The color based indicia comprises at least one color that is both detectable by a human observer having normal color vision and distinguishable by a human observer having normal color vision from the color of other color based indicia of which the integral identification feature is comprised and from the color(s) exhibited by adjacent portions of the chemical mechanical polishing pad at the polishing surface throughout the useful life of the chemical mechanical polishing pad.

The color based indicia, optionally, comprises at least two colors, wherein the at least two colors are selected to be observable as distinct indicia by a human observer (including individuals having a color vision impairment). Various tools have been developed to assist in the selection of such observable color based indicia. For example, "ColorBrewer" developed by Cynthia Brewer and Mark Harrower (http://www.personal.psu.edu/cab38/ColorBrewer/ColorBrewer.html).

In some embodiments of the present invention, the color based indicia comprises at least one colorant. There are a variety of ways in which the at least one colorant can be incorporated into the chemical mechanical polishing pad. For example, the colorant can be applied to or incorporated in at least a portion of the window for endpoint detection; the colorant can be applied to or incorporated in at least a portion of a subpad or intervening layer observable through the window; the colorant can be applied to or incorporated in at least a portion of an adhesive observable through the window. Optionally, the colorant is incorporated in at least a portion of an adhesive observable through the window, wherein the adhesive comprises a carrier film and wherein the colorant is uniformly distributed throughout the carrier film. Preferably, the chemical mechanical polishing pad is configured so that the at least one colorant is not exposed to polishing medium used with the chemical mechanical polishing pad during polishing.

Optionally, the polishing face and the nonpolishing face of the window are substantially parallel (i.e., within 5% of being parallel).

Optionally, the polishing face of the window is substantially parallel (i.e., within 5% of being parallel) with the polishing surface of the chemical mechanical polishing pad. The parallel polishing face of the window can optionally be coplanar with the polishing surface of the chemical mechanical polishing pad. Alternatively, the substantially parallel polishing face of the window can optionally be recessed from the polishing surface of the chemical mechanical polishing pad.

The chemical mechanical polishing pad of the present invention comprises a polishing layer 10 having a window 16, an integral identification feature 11, and a polishing surface 14; wherein the integral identification feature 11 is observable through the window 16 and identifies the chemical mechanical polishing pad as a type of chemical mechanical polishing pad selected from a plurality of chemical mechanical polishing pad types, and wherein the polishing surface is adapted for polishing a substrate selected from a magnetic substrate, an optical substrate and a semiconductor substrate. (see, e.g., FIG. 1).

Optionally the chemical mechanical polishing pad further comprises a central axis 12, wherein the chemical mechanical polishing pad is adapted for rotation about the central axis 12. Preferably, the polishing layer 10 is in a plane substantially perpendicular to the central axis 12 (i.e., ±10° from perpendicular). Preferably, the polishing layer 10 is adapted for rotation in a plane that is at an angle, γ, of 85 to 95° to the central axis 12, more preferably of 90° from the central axis 12. Preferably, the polishing layer 10 has a polishing surface 14 that has a substantially circular cross section perpendicular to the central axis 12. The longest radius, r, for a cross section of the polishing surface 14 perpendicular to the central axis 12 is preferably ≦20% longer than the shortest radius, r, for the cross section.

The window can be selected from a plug-in-place window and an integral window. Optionally, the integral identification feature comprises at least one color based indicia applied to or incorporated in an identifying portion of the window for endpoint detection. In some aspects of these embodiments, the color based indicia is outside the path for light used to facilitate endpoint detection. In some aspects of these embodiments, the color based indicia lies within the path for light used to facilitate endpoint detection but does not prevent effective endpoint detection. Preferably, the color based indicia comprises at least one colorant, wherein the at least one colorant is not present at the polishing face of the window.

Figure 2:
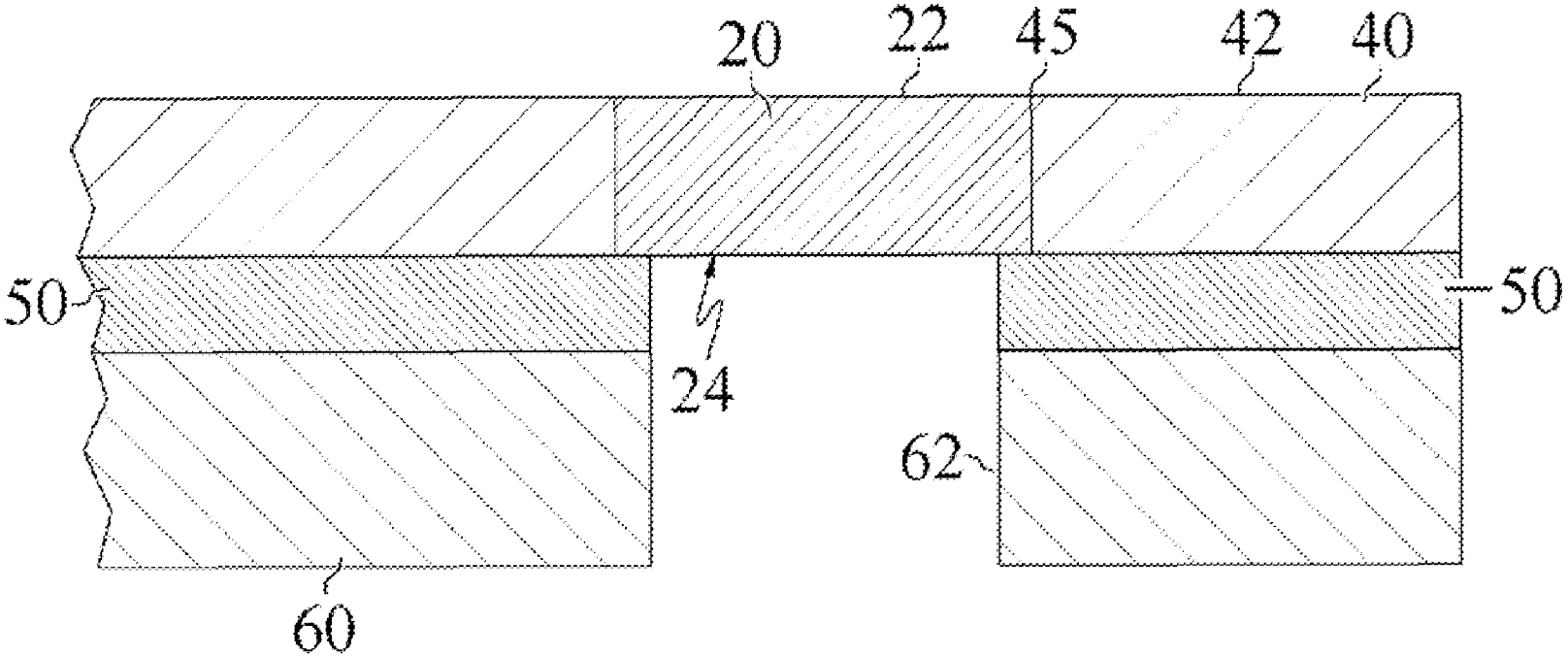
FIG. 2 is a cross sectional cut away view of a chemical mechanical polishing pad of the present invention.
Figure 3:
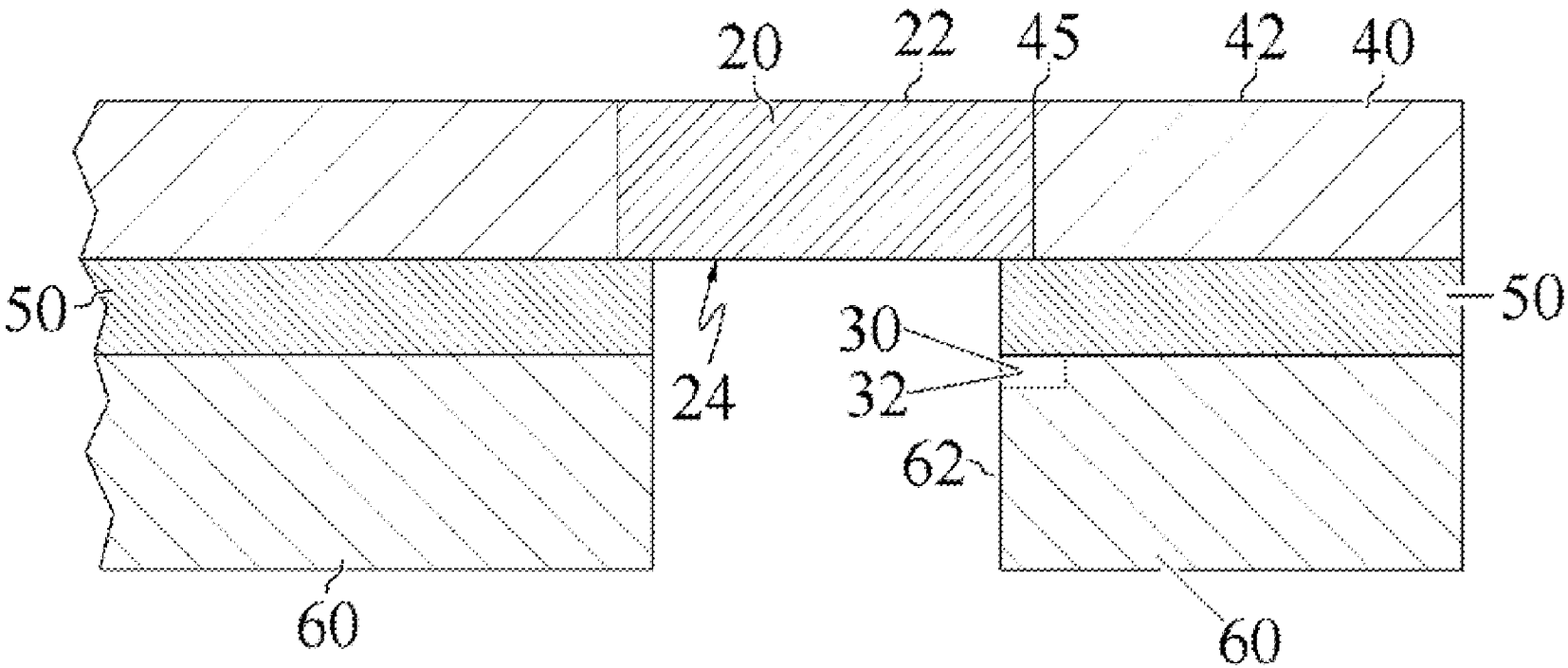
FIG. 3 is a cross sectional cut away view of a chemical mechanical polishing pad of the present invention.
Figure 4:
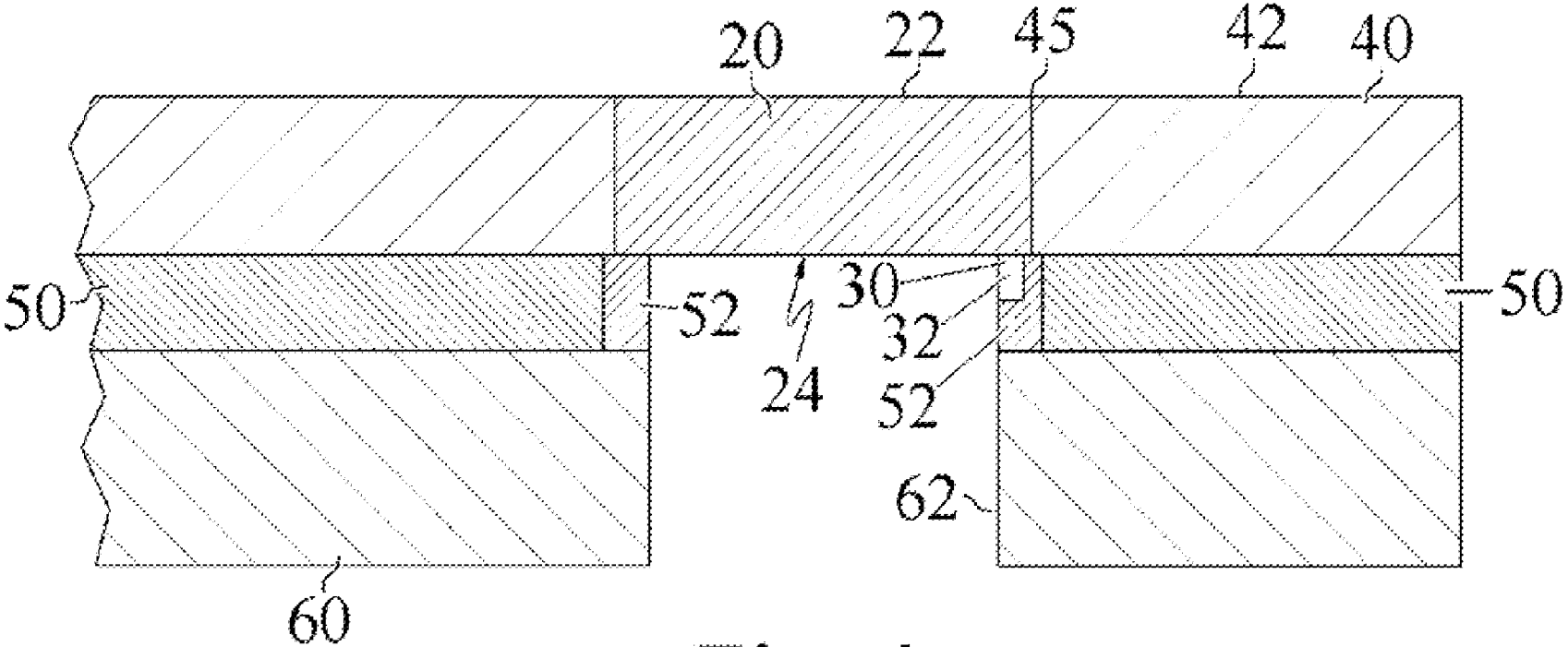
FIG. 4 is a cross sectional cut away view of a chemical mechanical polishing pad of the present invention.
Figure 5:
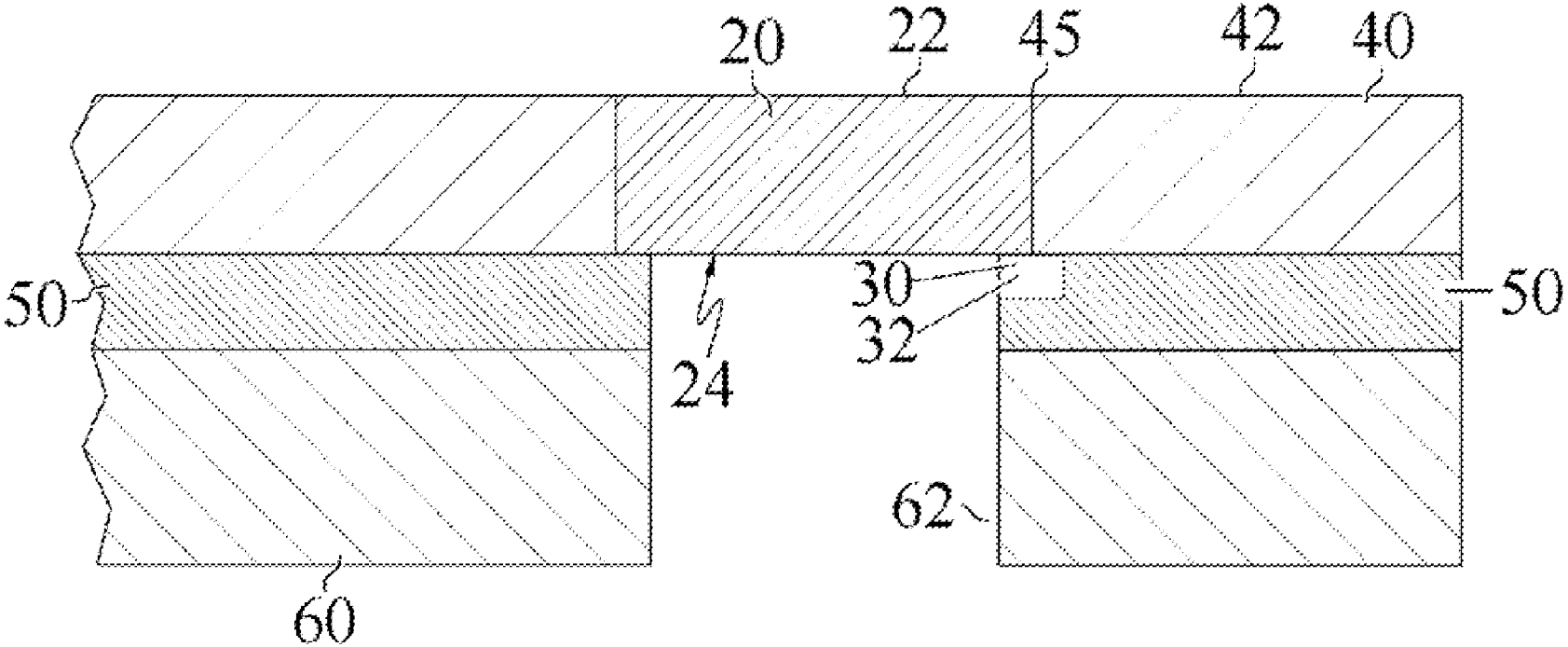
FIG. 5 is a cross sectional cut away view of a chemical mechanical polishing pad of the present invention.
Figure 6:
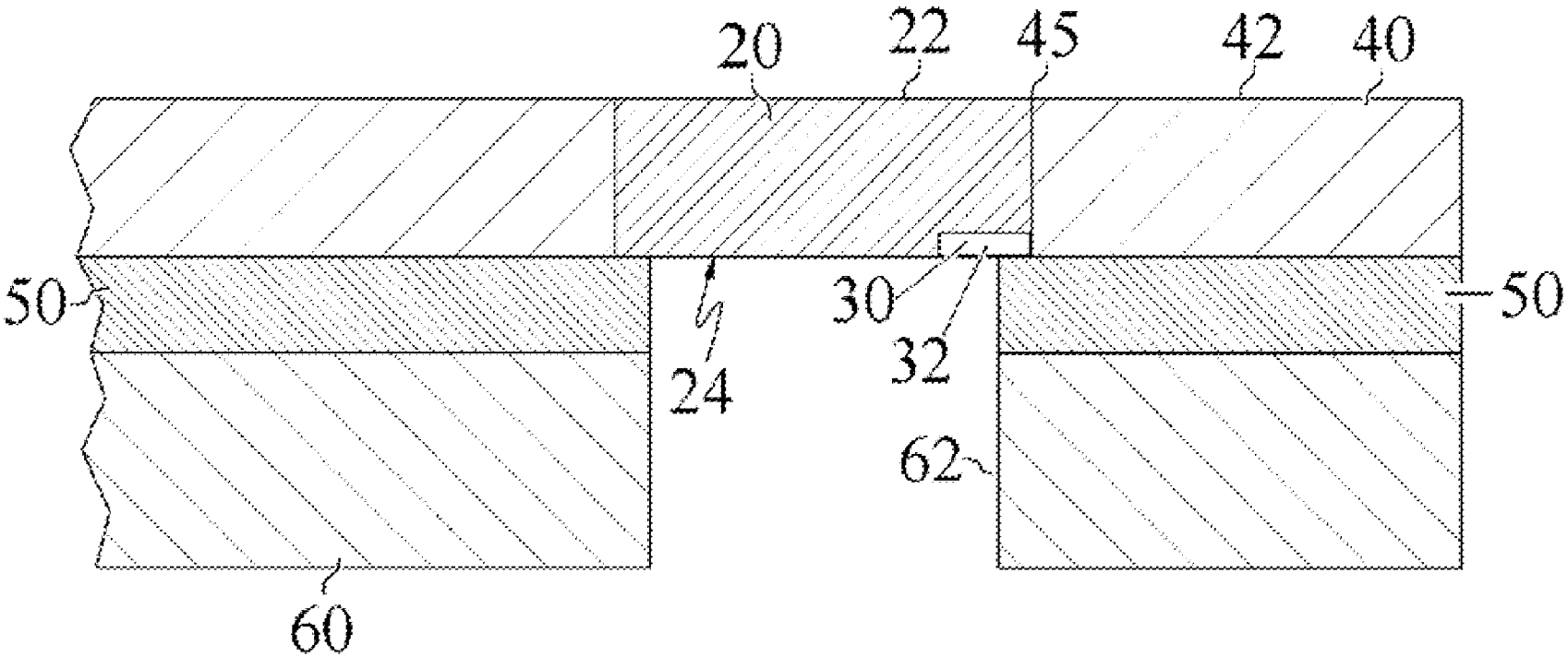
FIG. 6 is a cross sectional cut away view of a chemical mechanical polishing pad of the present invention.

The chemical mechanical polishing pad optionally further comprises a subpad 60. (see, e.g., FIG. 2). The subpad 60 optionally has an aperture 62 to facilitate endpoint detection. Preferably, the aperture 62 in the subpad 60 has a cross sectional area parallel to and smaller than the cross sectional area of a slice of the window 20 at or between the polishing face 22 and the nonpolishing face 24. In plug-in-place configurations, the window is optionally, at least one of: seated in an aperture 45 of the polishing layer 40, seated in the aperture 62 of subpad 60 and seated on a portion of subpad 60 using an adhesive. Optionally, the adhesive is selected from a window adhesive and a stack adhesive. Optionally, the integral identification feature 30 is applied to or incorporated in the subpad 60. (see, e.g., FIG. 3). Optionally, the integral identification feature 30 is applied to or incorporated in a window adhesive 52. (see, e.g., FIG. 4). Preferably, the window adhesive 52 is selected from a pressure sensitive adhesive, a contact adhesive and a reactive hot melt adhesive. Optionally, the integral identification feature 30 is applied to or incorporated in a stack adhesive 50 used to interface the polishing layer 40 with the subpad 60. (see, e.g., FIG. 5). Preferably, the stack adhesive 50 is selected from a pressure sensitive adhesive, a contact adhesive and a reactive hot melt adhesive. Optionally, the integral identification feature 30 is applied to or incorporated in at least a portion of the window 20. (see, e.g., FIG. 6). Preferably, the integral identification feature 30 comprises a color based indicia 32. Preferably, the color based indicia 32 is not present at the polishing surface 42 of the polishing layer 40 or the polishing face 22 of the window 20.

Figure 7:
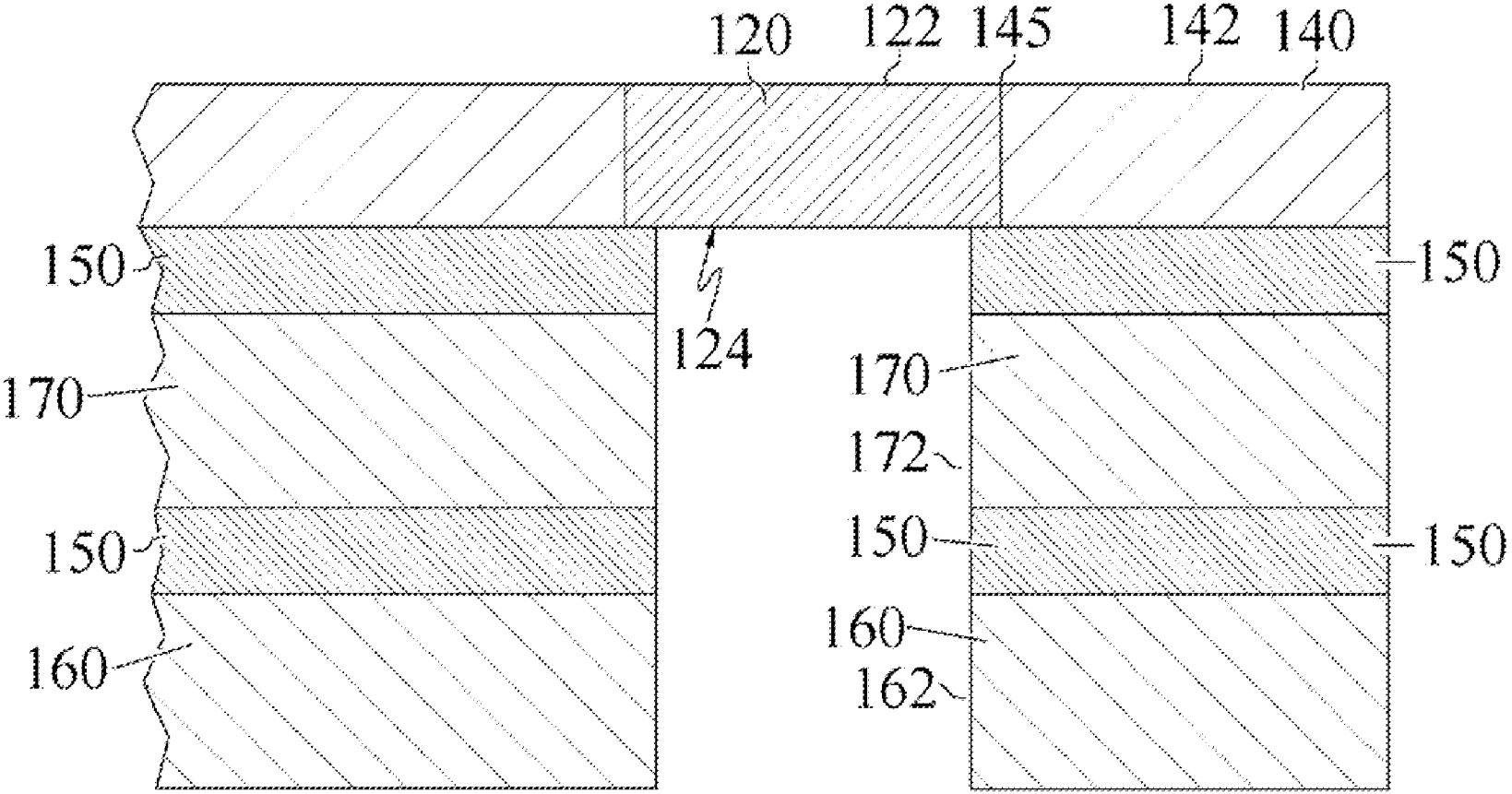
FIG. 7 is a cross sectional cut away view of a chemical mechanical polishing pad of the present invention.
Figure 8:
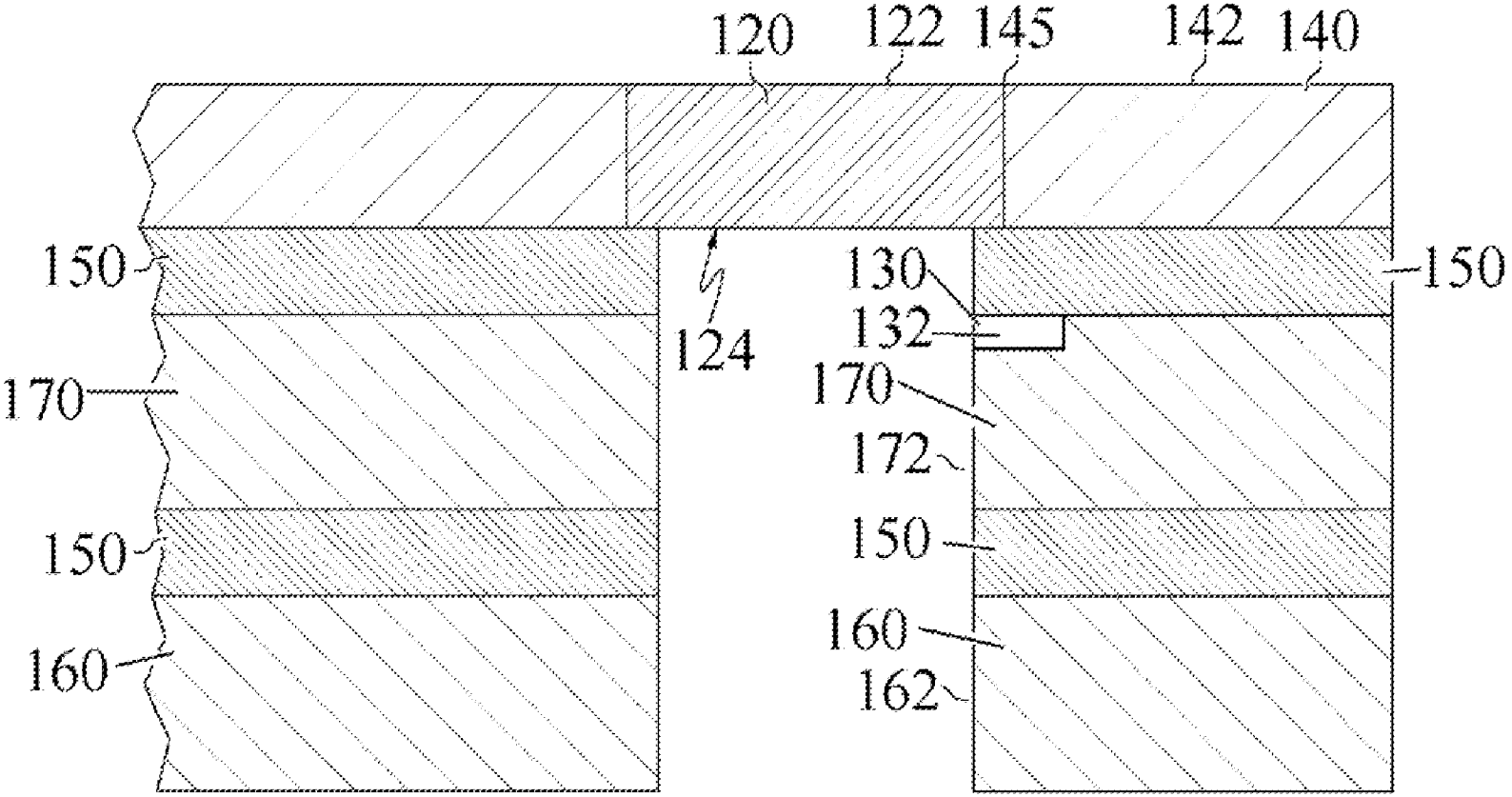
FIG. 8 is a cross sectional cut away view of a chemical mechanical polishing pad of the present invention.
Figure 9:
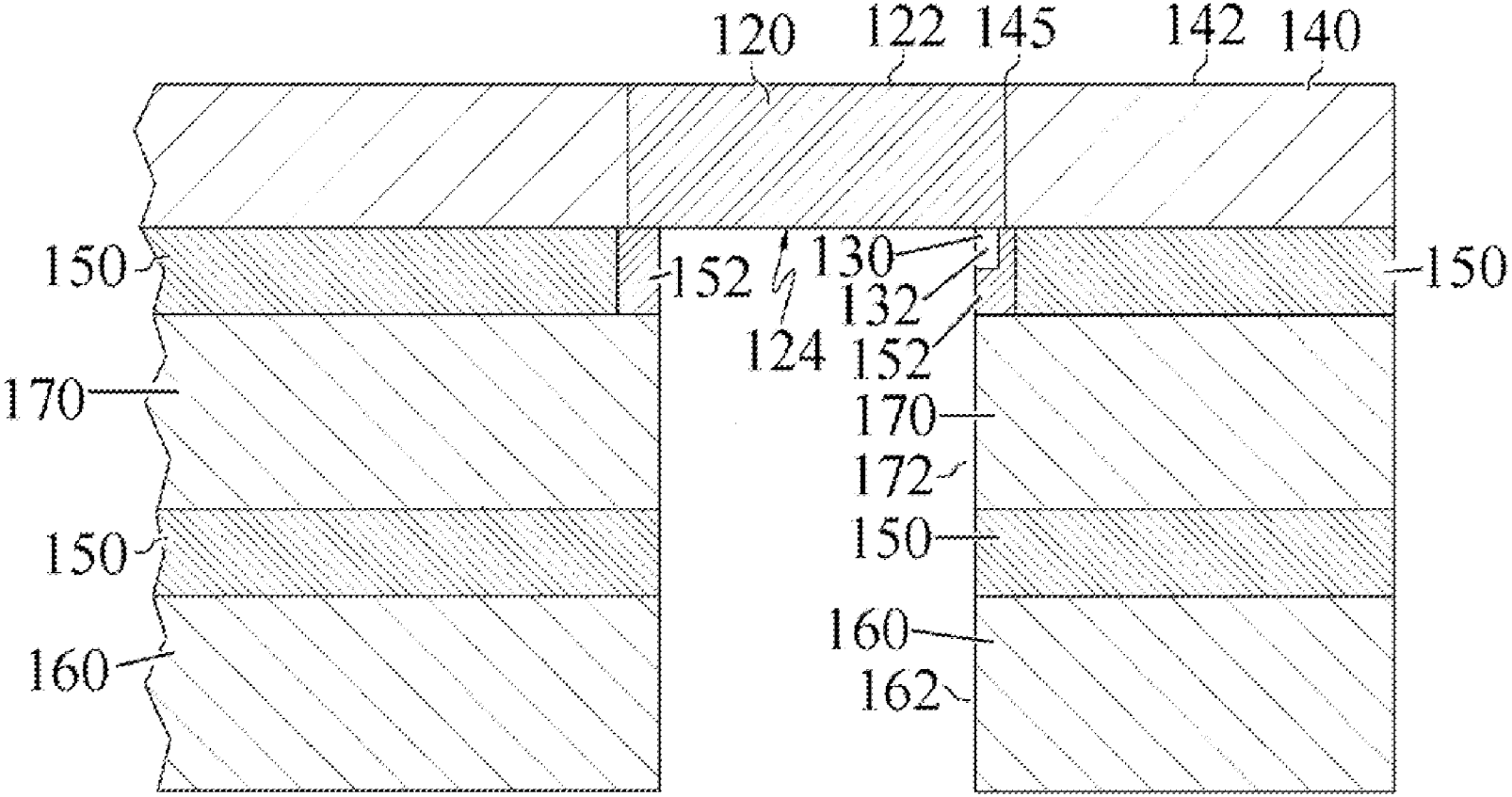
FIG. 9 is a cross sectional cut away view of a chemical mechanical polishing pad of the present invention.
Figure 10:
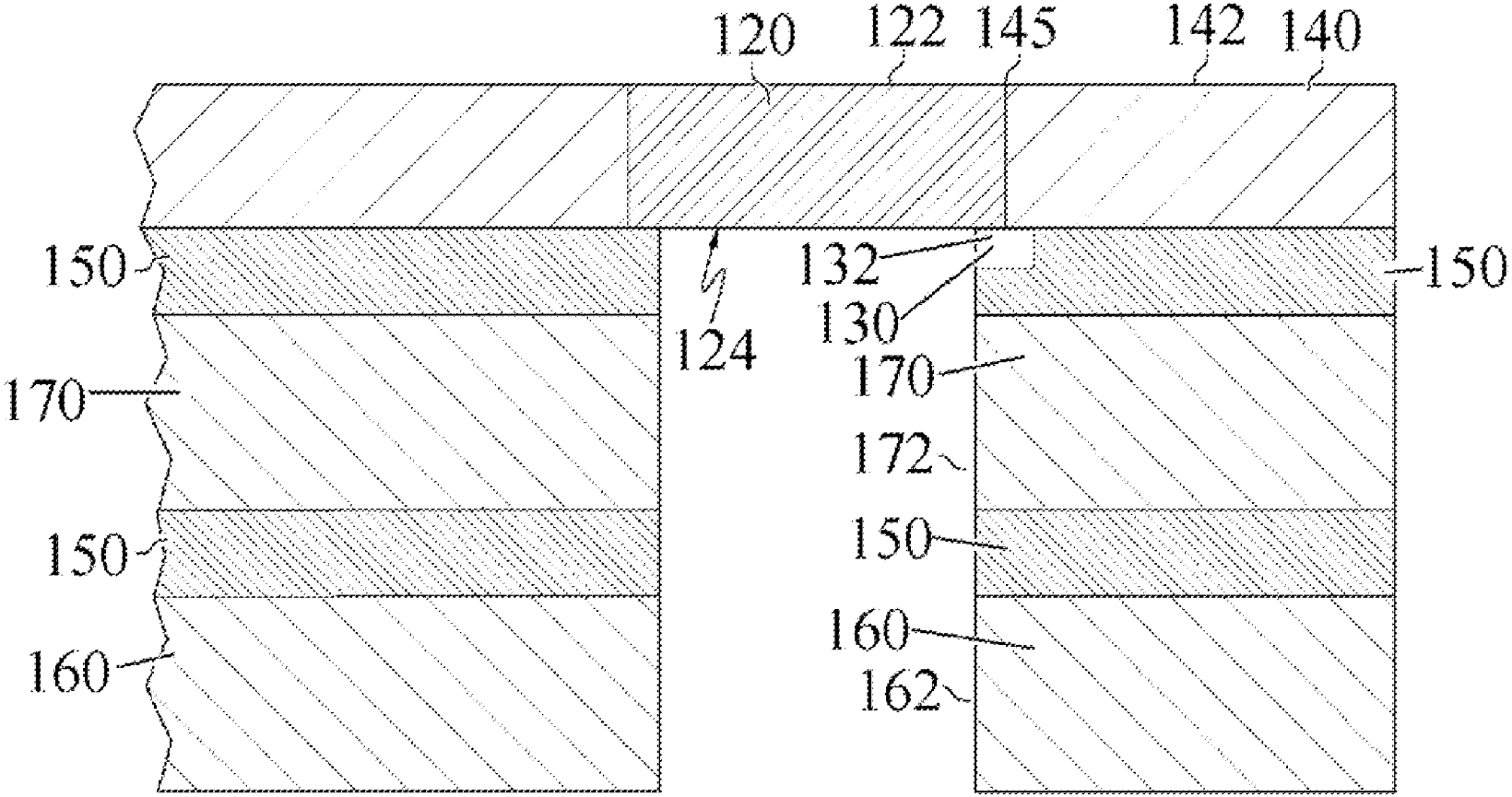
FIG. 10 is a cross sectional cut away view of a chemical mechanical polishing pad of the present invention.
Figure 11:
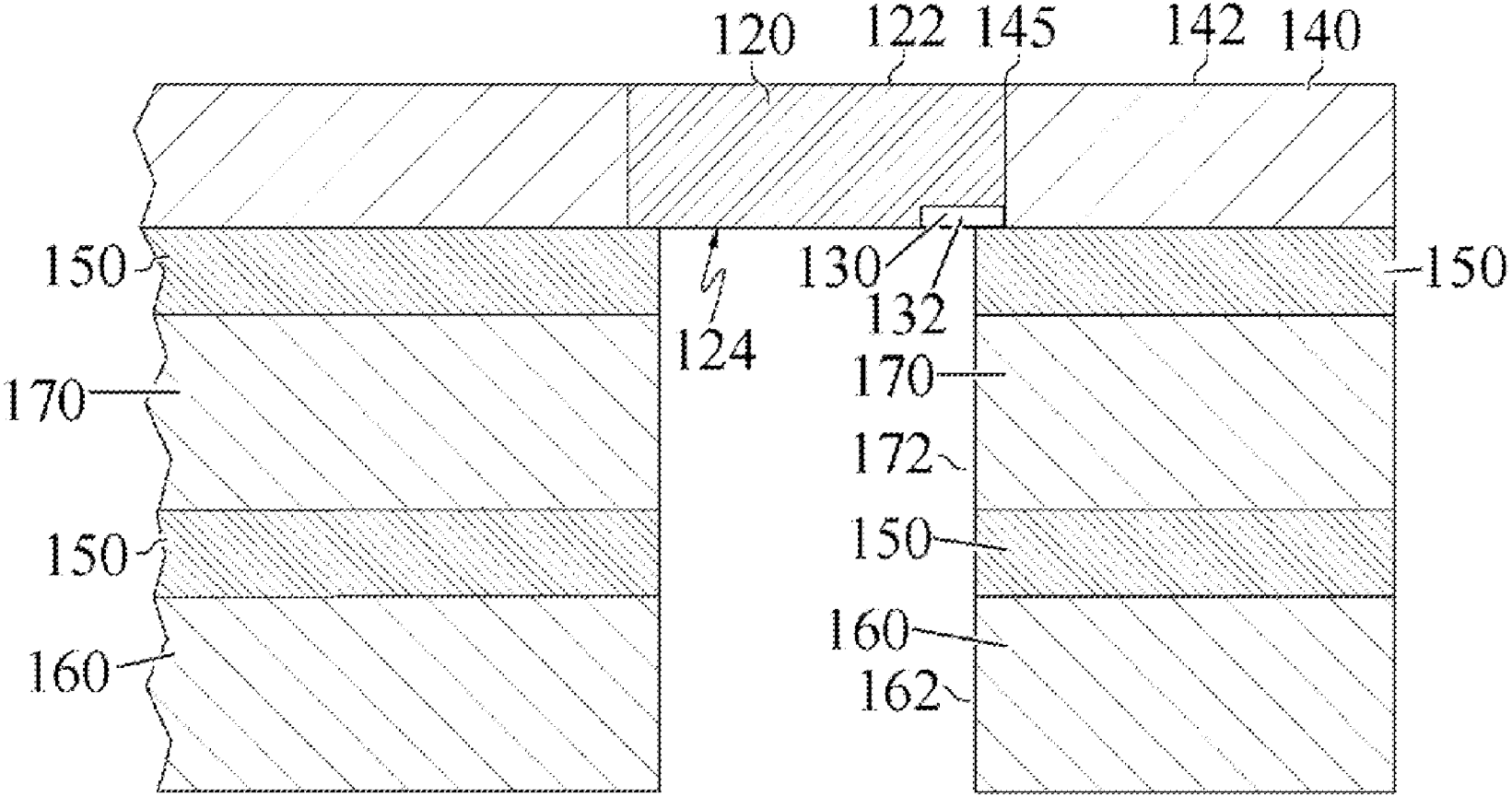
FIG. 11 is a cross sectional cut away view of a chemical mechanical polishing pad of the present invention.

The chemical mechanical polishing pad optionally further comprises a subpad 160 and at least one intervening layer 170. (see, e.g., FIG. 7). The subpad 160 and at least one intervening layer 170 optionally have an aperture 162 & 172, respectively, to facilitate endpoint detection. Preferably, the aperture in at least one of the subpad 160 and the at least one intervening layer 172 has a cross sectional area parallel to and smaller than the cross sectional area of a slice of the window 120 at or between the polishing face 122 and the nonpolishing face 124. In plug-in-place configurations, the window 120 is optionally, at least one of: seated in an aperture 145 in the polishing layer 140, seated in an aperture 162 in the subpad 160, seated in an aperture 172 of an intervening layer 170, seated on a portion of the subpad 160 and seated on a portion of an intervening layer 170 using an adhesive. Optionally, the adhesive is selected from a window adhesive and a stack adhesive. Optionally, the integral identification feature 130 is applied to or incorporated in the subpad 160 or an intervening layer 170. (see, e.g., FIG. 8). Optionally, the integral identification feature 130 is applied to or incorporated in a window adhesive 152. (see, e.g., FIG. 9). Preferably, the window adhesive 152 is selected from a pressure sensitive adhesive, a contact adhesive and a reactive hot melt adhesive. Optionally, the integral identification feature 130 is applied to or incorporated in a stack adhesive 150 used to interface at least two of the polishing layer 140, the window 120, the subpad 160 and intervening layer 170. (see, e.g., FIG. 10). Preferably, the stack adhesive 150 is selected from a pressure sensitive adhesive, a contact adhesive and a reactive hot melt adhesive. Optionally, the integral identification feature 130 is applied to or incorporated in at least a portion of the window 120. (see, e.g., FIG. 11). Preferably, the integral identification feature 130 comprises a color based indicia 132. Preferably, the color based indicia 132 is not present at the polishing surface 142 of the polishing layer 140 or the polishing face 122 of the window 120.

A method of making the chemical mechanical polishing pad of the present invention having a window with an integral identification feature, comprises: providing a chemical mechanical polishing layer with a polishing surface and a window, wherein the window has a polishing face and a nonpolishing face (optionally, wherein the polishing face and the polishing surface are substantially parallel (i.e., within 5% of being parallel)); providing an integral identification feature; and, interfacing the integral identification feature with the chemical mechanical polishing layer such that the integral identification feature is observable through the window at the polishing face; wherein the polishing surface is adapted for polishing the substrate. Preferably, the integral identification feature comprises a color based indicia observable through the window at the polishing face. Preferably, the color based indicia comprises a colorant that does not interfere with effective endpoint detection.

Optionally, the method of making the chemical mechanical polishing pad of the present invention having a window with an integral identification feature: further comprises applying a colorant to at least a portion of the nonpolishing face of the window.

Optionally, the method of making the chemical mechanical polishing pad of the present invention having a window with an integral identification feature: further comprises providing a subpad having an aperture. Preferably, the subpad is interfaced with the polishing layer using a stack adhesive. Optionally, the stack adhesive is selected from a pressure sensitive adhesive, a contact adhesive and a reactive hot melt adhesive. Optionally, the aperture in the subpad has a cross sectional area parallel to and smaller than the cross sectional area of the polishing face of the window and the integral identification feature is applied to or incorporated in at least a portion of the subpad adjacent to the aperture, wherein the integral identification feature is observable through the window at the polishing face. Optionally, the aperture in the subpad has a cross sectional area parallel to and smaller than the cross sectional area of the polishing face of the window and the integral identification feature is applied to or incorporated in at least a portion of the stack adhesive, wherein the integral identification feature is observable through the window at the polishing face. Preferably, the integral identification feature comprises a color based indicia observable through the window at the polishing face. Preferably, the color based indicia comprises a colorant that does not interfere with effective endpoint detection.

Optionally, the method of making the chemical mechanical polishing pad of the present invention having a window with an integral identification feature: further comprises providing an intervening layer having an aperture and a subpad having an aperture, wherein the intervening layer is interposed between the polishing layer and the subpad. Preferably, the polishing layer, the intervening layer and the subpad are interfaced using at least one stack adhesive. Optionally, the at least one stack adhesive is selected from a pressure sensitive adhesive, a contact adhesive and a reactive hot melt adhesive. Optionally, the aperture in the intervening layer has a cross sectional area parallel to and smaller than the cross sectional area of the polishing face of the window and the integral identification feature is applied to or incorporated in at least a portion of the intervening layer adjacent to the aperture, wherein the integral identification feature is observable through the window at the polishing face. Optionally, the aperture in the intervening layer has a cross sectional area parallel to and smaller than the cross sectional area of the polishing face of the window and the integral identification feature is applied to or incorporated in at least a portion of (i) the stack adhesive interposed between the intervening layer and the polishing layer, or (ii) the stack adhesive interposed between the intervening layer and the subpad; wherein the integral identification feature is observable through the window at the polishing face. Preferably, the integral identification feature comprises a color based indicia observable through the window at the polishing face. Preferably, the color based indicia comprises a colorant that does not interfere with effective endpoint detection.

Optionally, the window used in the methods of the invention can be selected from integral windows and plug-in-place windows.

A method of making the chemical mechanical polishing pad of the present invention having a plug-in-place window with an integral identification feature, comprises: providing a chemical mechanical polishing layer with a polishing surface and an aperture; providing a plug-in-place window for endpoint detection, having a polishing face and a nonpolishing face; providing an integral identification feature; and, interfacing the plug-in-place window with the polishing layer such that the integral identification feature is observable through the plug-in-place window at the polishing surface; wherein the polishing surface is adapted for polishing a substrate selected from a magnetic substrate, an optical substrate and a semiconductor substrate. Preferably, the integral identification feature comprises a color based indicia observable through the plug-in-place window at the polishing face. Preferably, the color based indicia comprises a colorant that does not interfere with effective endpoint detection.

A method of making the chemical mechanical polishing pad of the present invention having a plug-in-place window with an integral identification feature, comprises: providing a chemical mechanical polishing layer with a polishing surface and an aperture, providing a subpad having an aperture; providing a plug-in-place window for endpoint detection, having a polishing face and a nonpolishing face; providing an integral identification feature; and, interfacing the plug-in-place window with the subpad such that the integral identification feature is observable through the plug-in-place window at the polishing face; wherein the polishing surface is adapted for polishing a substrate selected from a magnetic substrate, an optical substrate and a semiconductor substrate. Preferably, the integral identification feature comprises a color based indicia observable through the plug-in-place window at the polishing face. Preferably, the color based indicia comprises a colorant that does not interfere with effective endpoint detection.

Optionally, the method of making the chemical mechanical polishing pad of the present invention having a plug-in-place window with an integral identification feature: further comprises applying an integral identification feature to or incorporating an integral identification feature in at least a portion of the plug-in-place window. Preferably, the portion of the window to which the integral identification feature is applied does not include the polishing face. Most preferably, the integral identification feature is applied to the nonpolishing face of the plug-in-place window. Optionally, the integral identification feature is applied to or incorporated in at least a portion of the plug-in-place window before it is interfaced with another component of the chemical mechanical polishing pad (e.g., the polishing layer, the subpad, an intervening layer, an adhesive). Optionally, the integral identification feature is applied to or incorporated in at least a portion of the plug-in-place window after it is interfaced with another component of the chemical mechanical polishing pad.

Optionally, the method of making the chemical mechanical polishing pad of the present invention having a plug-in-place window with an integral identification feature: further comprises providing a subpad having an aperture that communicates with the aperture in the polishing layer to facilitate endpoint detection. Preferably, the subpad is interfaced with the plug-in-place window using an adhesive. Optionally, the adhesive is selected from a pressure sensitive adhesive, a contact adhesive and a reactive hot melt adhesive. Optionally, the aperture in the subpad has a cross sectional area parallel to and smaller than the cross sectional area of at least a slice of the plug-in-place window at or between the polishing face and the nonpolishing face and the integral identification feature is applied to or incorporated in at least a portion of the subpad adjacent to the aperture, wherein the integral identification feature is observable through the plug-in-place window at the polishing face. Optionally, the aperture in the subpad has a cross sectional area parallel to and smaller than the cross sectional area of at least a slice of the plug-in-place window at or between the polishing face and the nonpolishing face and the integral identification feature is applied to or incorporated in at least a portion of the adhesive, wherein the integral identification feature is observable through the plug-in-place window at the polishing face. Optionally, the chemical mechanical polishing pad further comprises at least one intervening layer between the polishing layer and the subpad.

Optionally, the method of making the chemical mechanical polishing pad of the present invention having a plug-in-place window with an integral identification feature: further comprises providing an intervening layer and a subpad, wherein the intervening layer is interposed between the polishing layer and the subpad. Preferably, the plug-in-place window is interfaced with at least one of the polishing layer, the intervening layer and the subpad using an adhesive. Optionally, the adhesive is selected from a pressure sensitive adhesive, a contact adhesive and a reactive hot melt adhesive. Optionally, the aperture in the intervening layer has a cross sectional area parallel to and smaller than the cross sectional area of at least a slice of the plug-in-place window at or between the polishing face and the nonpolishing face and the integral identification feature is applied to or incorporated in at least a portion of the intervening layer adjacent to the aperture, wherein the integral identification feature is observable through the window at the polishing face. Optionally, the aperture in the intervening layer has a cross sectional area parallel to and smaller than the cross sectional area of at least a slice of the plug-in-place window at or between the polishing face and the nonpolishing face and the integral identification window is applied to or incorporated in at least a portion of (i) an adhesive interposed between the intervening layer and the polishing layer, or (ii) an adhesive interposed between the intervening layer and the subpad; wherein the integral identification feature is observable through the window at the polishing face.

The method for chemical mechanical polishing of a substrate selected from a magnetic substrate, an optical substrate and a semiconductor substrate; comprises: providing a chemical mechanical polishing apparatus having a platen; providing at least one substrate selected from a magnetic substrate, an optical substrate and a semiconductor substrate; providing at least two polishing operations; providing a plurality of types of chemical mechanical polishing pads; wherein each type of chemical mechanical polishing pad has different polishing properties and an integral identification feature to distinguish each type of chemical mechanical polishing pad from the other types of chemical mechanical polishing pads in the plurality of types; wherein the integral identification feature is non-polish active; optionally, wherein the integral identification feature comprises a color based indicia; and, optionally, wherein the color based indicia is selected to be observable through the window and to uniquely identify each type of chemical mechanical polishing pad in the plurality of types; providing at least two polishing recipes, wherein each polishing recipe corresponds to one of the at least two polishing operations and wherein each polishing recipe includes an identification of the integral identification feature associated with the type of chemical mechanical polishing pad to be used; selecting a polishing operation to be performed from the at least two polishing operations ("the selected polishing operation") and a corresponding polishing recipe ("the selected recipe"); installing onto the platen the type of chemical mechanical polishing pad identified in the selected recipe ("the first installed polishing pad"); observing the integral identification feature of the first installed polishing pad and verifying that it corresponds with that identified in the selected recipe; and performing the selected polishing operation on the at least one substrate. The method may optionally further comprise: selecting a subsequent polishing operation from the at least two polishing operations ("the subsequent polishing operation") and a corresponding subsequent polishing recipe ("the subsequent recipe"); installing onto the platen the type of chemical mechanical polishing pad identified in the subsequent recipe ("the subsequently installed polishing pad"); observing the integral identification feature of the subsequently installed polishing pad and verifying that it corresponds with that identified in the subsequent recipe; and performing the subsequent polishing operation on the at least one substrate. The multiple polishing operations can be performed using a single chemical mechanical polishing apparatus, wherein the multiple polishing operations are performed on the same substrate using at least two different types of chemical mechanical polishing pads (e.g., multiple polishing operations on a given semiconductor wafer). The multiple polishing operations can be performed on the same chemical mechanical polishing apparatus, wherein the multiple polishing operations are performed on different substrates and wherein at least two different types of chemical mechanical polishing pads are used. Also, multiple chemical mechanical polishing apparatuses can be used. When multiple apparatuses are used, each separate apparatus can be used to perform the same type of polishing operation(s) or they can be set up to perform different types of polishing operations. Preferably, the substrate is a semiconductor substrate. More preferably, the substrate is a semiconductor wafer.

The method for chemical mechanical polishing of a substrate selected from a magnetic substrate, an optical substrate and a semiconductor substrate; comprises: providing a chemical mechanical polishing apparatus having a platen; providing at least one substrate selected from a magnetic substrate, an optical substrate and a semiconductor substrate; providing at least two polishing operations; providing at least two types of chemical mechanical polishing pads, wherein each type of chemical mechanical polishing pad has different polishing properties and an integral identification feature, wherein the integral identification feature is nonpolish active, wherein the integral identification feature comprises a color based indicia, wherein the color based indicia is selected to be observable through the window and to uniquely identify each type of chemical mechanical polishing pad in the plurality of types, and wherein the color based indicia is unique for each type of chemical mechanical polishing pad in the plurality of types; providing at least two polishing recipes, wherein each polishing recipe corresponds to one of the at least two polishing operations and wherein each polishing recipe includes an identification of the integral identification feature for the type of chemical mechanical polishing pad to be used, including the identification of the color based indicia; providing a control system for controlling the chemical mechanical polishing apparatus; providing a color sensor capable of recognizing and distinguishing the color based indicia for each type of chemical mechanical polishing pad in the plurality of types; selecting the polishing operation to be performed ("the selected polishing operation") along with the corresponding polishing recipe ("the selected recipe"); installing a chemical mechanical polishing pad of the type of chemical mechanical polishing pad identified in the selected recipe onto the platen ("the first installed pad"); sensing the color of the color based indicia for the first installed pad using the color sensor and providing a color input to the control system; automatically verifying that the first installed pad is of the type of chemical mechanical polishing pad identified in the selected recipe by comparing the color input with the identified color based indicia in the selected recipe; and performing the selected polishing operation on the at least one substrate. The method may optionally further comprise: providing an interlock, wherein the interlock prevents the chemical mechanical polishing apparatus from performing the selected polishing operation if the color input does not correspond with the identified color based indicia in the selected recipe. The method may optionally further comprise: selecting another polishing operation from the at least two polishing operations ("the subsequent polishing operation") and a corresponding subsequent polishing recipe ("the subsequent recipe"); installing onto the platen the type of chemical mechanical polishing pad identified in the subsequent recipe ("the subsequently installed pad"); automatically verifying that the color of the color based indicia for the subsequently installed pad for the subsequent polishing operation corresponds with the identified color based indicia in the subsequent recipe using the sensor; performing the subsequent polishing operation on the at least one substrate if the type of chemical mechanical polishing pad identified in the subsequent recipe is installed. The method may optionally further comprise: observing the integral identification feature of the installed chemical mechanical polishing pad and verifying that it corresponds with that identified in the recipe for the polishing operation to be performed; and performing the polishing operation on the at least one substrate, provided that the type of chemical mechanical polishing pad installed is of the type identified in the recipe for the polishing operation to be performed. Multiple polishing operations may be performed using the chemical mechanical polishing apparatus, wherein the multiple polishing operations are performed on the same substrate using at least two different types of chemical mechanical polishing pads (e.g., multiple polishing operations on a given semiconductor wafer). Preferably, multiple polishing operations are performed using the chemical mechanical polishing apparatus, wherein the multiple polishing operations are performed on different substrates and wherein at least two different types of chemical mechanical polishing pads are used. Preferably, the substrate is a semiconductor substrate. More preferably, the substrate is a semiconductor wafer.

We claim:

1. A method for chemical mechanical polishing of a substrate selected from a magnetic substrate, an optical substrate and a semiconductor substrate, comprising:

providing a chemical mechanical polishing apparatus having a platen;

providing at least one substrate selected from a magnetic substrate, an optical substrate and a semiconductor substrate;

providing at least two polishing operations;

providing a plurality of types of chemical mechanical polishing pads having a window, wherein each type of chemical mechanical polishing pad has different polishing properties and an integral identification feature to distinguish each type of chemical mechanical polishing pad from the other types of chemical mechanical polishing pads in the plurality of types, wherein the integral identification feature is non-polish active, wherein the integral identification feature is selected to be observable through the window and to uniquely identify each type of chemical mechanical polishing pad in the plurality of types;

providing at least two polishing recipes, wherein each polishing recipe corresponds to one of the at least two polishing operations and wherein each polishing recipe includes an identification of the integral identification feature associated with the type of chemical mechanical polishing pad to be used;

selecting a polishing operation to be performed from the at least two polishing operations ("the selected polishing operation") and a corresponding polishing recipe ("the selected recipe");

installing onto the platen the type of chemical mechanical polishing pad identified in the selected recipe;

observing the integral identification feature of the installed chemical mechanical polishing pad and verifying that it corresponds with that identified in the selected recipe; and performing the selected polishing operation on the at least one substrate.

2. A chemical mechanical polishing pad for polishing a substrate selected from a magnetic substrate, an optical substrate and a semiconductor substrate; comprising:

a polishing layer having a polishing surface adapted for polishing the substrate, a window and an integral identification feature; and, wherein the window has a polishing face and a nonpolishing face, wherein the integral identification feature is observable through the window, wherein the integral identification feature identifies the chemical mechanical polishing pad as a type of chemical mechanical polishing pad selected from a plurality of types of chemical mechanical polishing pads.

3. The chemical mechanical polishing pad of claim 1, wherein the integral identification feature is not incorporated in the polishing layer.

4. The chemical mechanical polishing pad of claim 1, wherein the integral identification feature comprises a color based indicia applied to an identifying portion of the nonpolishing face of the window.

5. The chemical mechanical polishing pad of claim 1, wherein the window is selected from a plug-in-place window and an integral window.

6. A method of making the chemical mechanical polishing pad having a window with an integral identification feature, comprising:

providing a polishing layer with a polishing surface and a window, wherein the window has a polishing face and a nonpolishing face and wherein the polishing face is parallel with the polishing surface;

providing an integral identification feature; and, interfacing the integral identification feature with the polishing layer;

wherein the integral identification feature is observable through the window at the polishing face throughout the useful lifetime of the chemical mechanical polishing pad; and, wherein the polishing surface is adapted for polishing the substrate.

7. The method of claim 6, wherein the integral identification feature comprises a color based indicia applied to a portion of the nonpolishing face of the window.

8. The method of claim 6, further comprising:

providing a subpad having an aperture; and, interfacing the subpad and the polishing layer.

9. The method of claim 8, wherein the aperture is dimensionally smaller than the polishing face of the window; wherein the integral identification feature comprises a color based indicia applied to a portion of the subpad adjacent to the aperture.

10. The method of claim 6; wherein the window is selected from an integral window and a plug-in-place window.

* * * * *